United States Patent [19]

Higginbotham

[11] Patent Number: 5,016,397

[45] Date of Patent: May 21, 1991

[54] METHOD AND APPARATUS FOR REMOVING WRAPPERS FROM COIN ROLLS

[76] Inventor: Daryle Higginbotham, 287 Maple Ave., Marietta, Ga. 30064

[21] Appl. No.: 498,011

[22] Filed: Mar. 23, 1990

[51] Int. Cl.[5] ..... B24B 7/12; B24B 5/18; G07D 9/00; B65F 3/02

[52] U.S. Cl. ..... 51/80 A; 51/103 TF; 414/412; 453/63

[58] Field of Search ..... 414/412; 453/63, 8; 198/757, 609; 51/80 A, 102, 103 TF, 74 R, DIG. 17

[56] References Cited

U.S. PATENT DOCUMENTS

| | | | |
|---|---|---|---|
| 990,909 | 5/1911 | Sattley | 453/8 |
| 2,166,171 | 7/1939 | McBean . | |
| 2,887,702 | 5/1955 | Freitag . | |
| 3,534,422 | 11/1968 | Carpenter et al. . | |
| 4,038,746 | 8/1977 | Bromley | 30/2 |
| 4,633,995 | 1/1986 | Hamada | 198/757 X |
| 4,822,235 | 4/1989 | Hipp | 453/63 X |

FOREIGN PATENT DOCUMENTS

| | | | |
|---|---|---|---|
| 5237297 | 3/1977 | Japan | 51/80 A |

*Primary Examiner*—Frederick R. Schmidt
*Assistant Examiner*—Bruce P. Watson
*Attorney, Agent, or Firm*—Thomas, Kerr, & Kayden

[57] ABSTRACT

An apparatus for removing wrappers from coin rolls comprises a cascade type vibrating feeder bowl for aligning wrapped coin rolls and feeding them serially to the upper end of a coin roll chute that slopes downwardly to a lower end. A pair of contra-rotatable abrasive discs overlie and partially straddle the chute at a predetermined location along its length and a vibrating separator for separating loose coins from their torn wrappers underlies the lower end of the chute. In use, wrapped coin rolls are fed to the chute and are directed thereby to the abrasive discs. The abrasive discs, then, bear against the rolls within the chute to tear away their paper wrappers whereupon the resulting loose coins and torn wrappers fall into the separator where the coins are separated from their torn wrappers for collection.

11 Claims, 3 Drawing Sheets

Fig 1
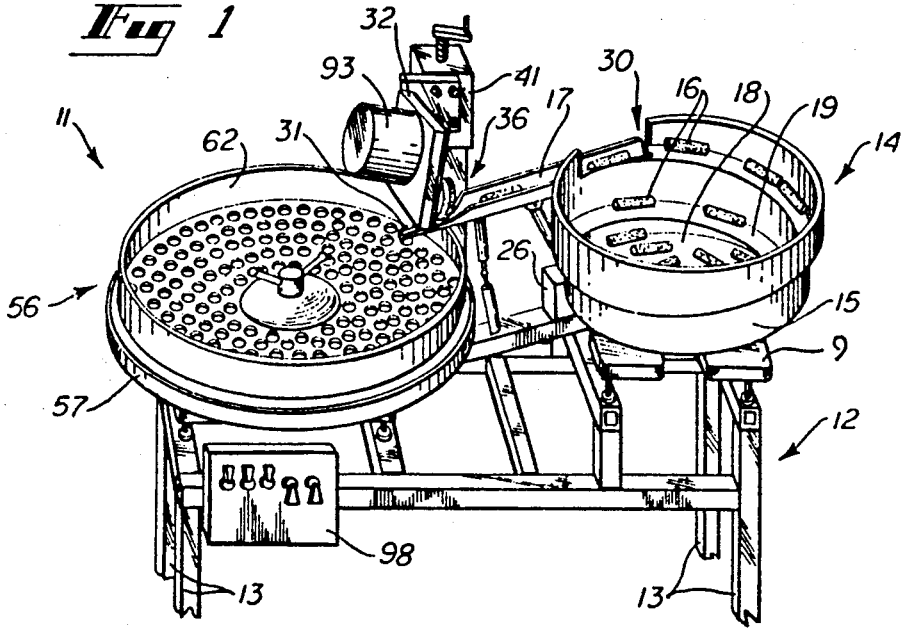
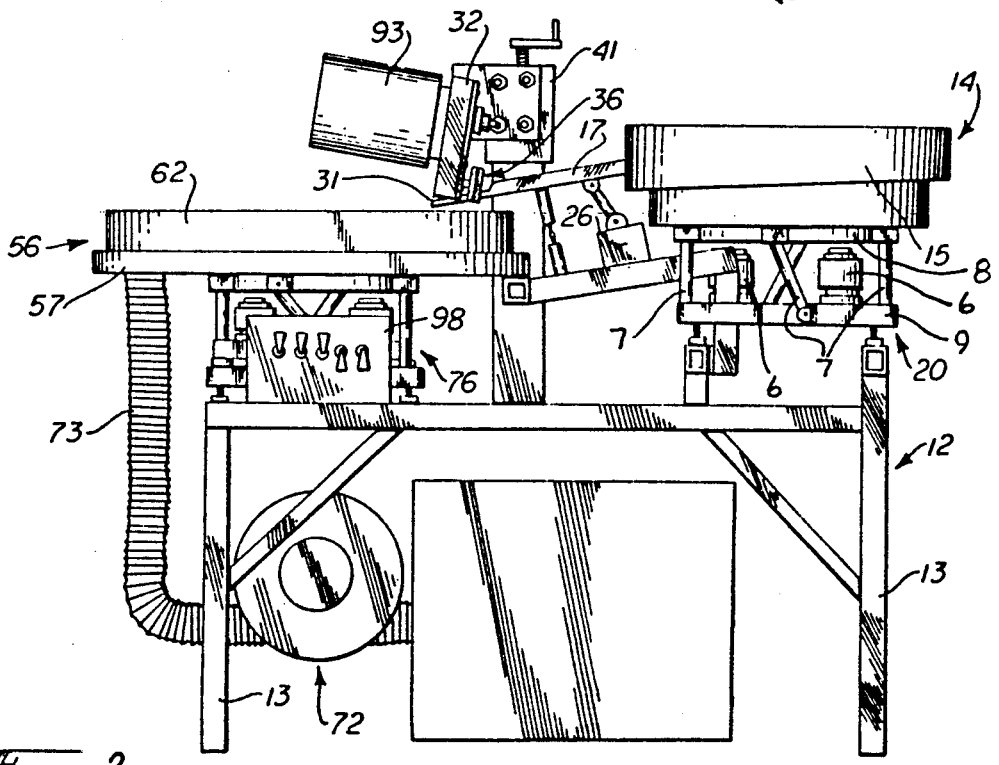
Fig 2

METHOD AND APPARATUS FOR REMOVING WRAPPERS FROM COIN ROLLS

TECHNICAL FIELD

This invention relates to coin handling and particularly to the removal of exterior wrappers from rolls of coins.

BACKGROUND OF THE INVENTION

It has long been the practice of bands and other institutions that handle large numbers of coins to arrange like coins in stacks or rolls of fifty and secure the rolls with an exterior wrapper of paper or plastic for ease of sorting, counting and transport. Such institutions also commonly find it necessary to remove large numbers of coins from their exterior wrappers for subsequent processing of the coins as, for example, in automated machinery. In the past, such removal has largely been accomplished by hand through the use of various implements and tools such as that disclosed in U.,S. Pat. No. 4,038,746 of Bromley. Sometimes, no tools are used at all and the rolls are simply smashed against a stationary object to break open the exterior wrappers whereupon the coins can be emptied into a collector.

While these manual methods of removing coins from their wrappers have been somewhat successful, they nevertheless have proven to be plagued with numerous inherent problems and shortcomings. Labor costs for such manual operations, for example, can be exceedingly high, particularly where large volumes of coins must be unwrapped on a continuing basis. Further, institutions often find it difficult to retain employees for unwrapping coin dolls because of the inherent boring and unchallenged nature of the job. Finally, as with most manual operations, unwrapping the coins by hand is slow and tedious and often becomes the bottle neck in a series of mostly automated coin handling processes.

A continuing and heretofore unaddressed need therefore exists for a method and enabling apparatus adapted to remove the wrappers from coin rolls quickly, reliably, automatically and with a minimum of required human intervention. It is to the provision of such a method and apparatus that the present invention is primarily directed.

SUMMARY OF THE INVENTION

The present invention is an automated method and apparatus for removing the exterior wrappers from rolls of coins and subsequently separating the resulting loose coins from the remains of their wrappers for further processing. The apparatus comprises a pair of contra-rotating abrasive discs that overlie and at least partially straddle the lower end of an elongated sloped vibrating chute down which wrapped coin rolls move. The abrasive discs are arranged and positioned to bear against the coin rolls within the chute as they pass the discs to abrade away a portion of the wrappers thus stripping them from about the rolled coins therein. A separating pan that has a formainous place spaced above the pan floor is positioned to receive the loose coins and wrapper remains from the chute. Electromagnets are coupled to vibrate the separating pan such that the coins pass through the formainous plate into the bottom of the pan and through a coin outlet from where they are collected. The wrapper remains, however, remain atop the formainous plate where they can be collected for disposal. A vibrating cascade feeder bowl is adapted to contain a multitude of wrapped coin rolls and feed them continuously and sequentially to the vibrating chute for wrapper removal . The method of the invention includes the steps of moving wrapped coin rolls sequentially along a path, engaging the wrapped rolls with a pair of contra-rotating abrasive discs to strip the wrappers from the coins, separating the loose coins for the remains of their wrappers and collecting the coins for further processing.

Thus, a method and apparatus for removing wrappers from coin rolls is now provided wherein wrapped coin rolls are feed automatically from a reservoir to a cutting station where the wrappers are stripped from the rolled coins therein, whereupon the coins and wrapper remains are automatically separated and the coins collected. The apparatus is reliable, many times faster than removal of coin wrappers by hand and can operate continuously for long periods of time with a minimum of required human intervention. Additional objects, features and advantages of the invention will become apparent upon review of the following detailed description taken in conjunction with the accompanying drawings.

BRIEF DESCRIPTION OF THE DRAWINGS

FIG. 1 is a perspective view of an apparatus that embodies principals of the invention in a preferred form.

FIG. 2 is a side elevational view of the apparatus of FIG. 1 illustrating functional elements thereof.

DETAILED DESCRIPTION

Figure 3:
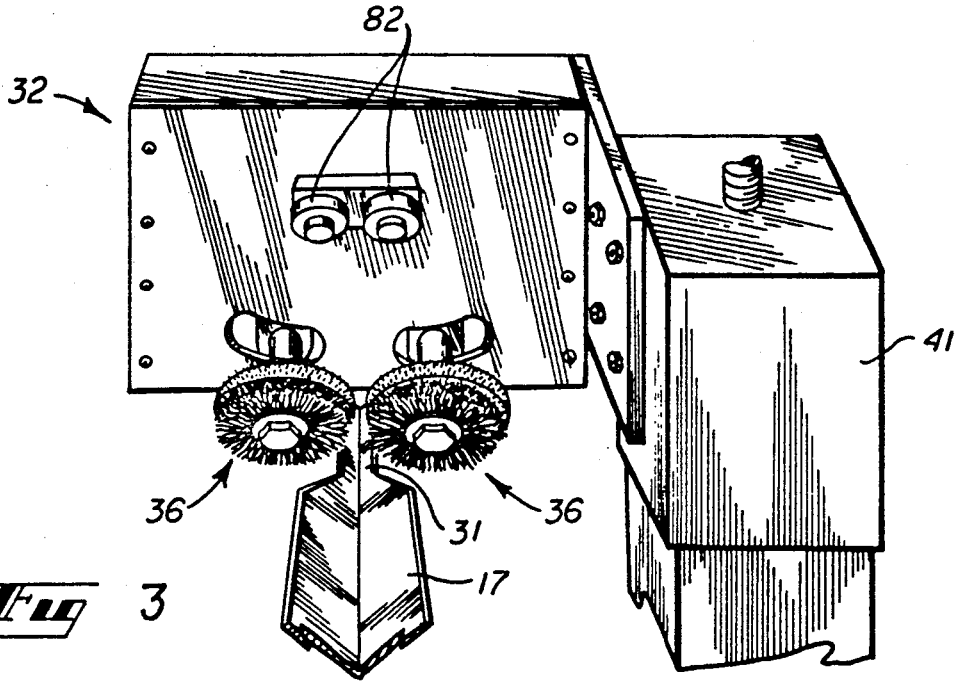
FIG. 3 is a perspective view of the contra-rotating abrasive discs shown partially straddling the lower end portion of the coin roll chute.

Referring now in more detail to the drawings, in which like numerals represent like parts throughout the several views, FIGS. 1 and 2 illustrate an apparatus 11 that embodies principles of the invention in a preferred form. The apparatus 11 is seen to include a frame 12 that has vertically extending legs 13 for supporting functional elements of the invention at a convenient working height.

Supported atop the frame 12 on the right side thereof in FIGS. 1 and 2 is a cascade type vibrating feeder bowl assembly 14. The feeder bowl assembly 14 comprises a bowl 15 that has a central reservoir 18 for receiving wrapped coin rolls 16. The peripheral wall of the bowl 15 is formed to define a spiral ramp 19 communicating at its lower end with the reservoir 18 and terminating at its upper end in a bowl exit port 30. The bowl 15 is mounted atop a standard electromagnetically driven vibrator mechanism 20 such as that available from Automation Devices, Inc. of Erie. Pa.

In general, the mechanism 20 includes a lower plate 9 and a ferrous upper plate 8 joined by angled spring supports 7. A pair of electromagnets 6 are mounted to the lower plate 9 and extend upward to within a predetermined small distance from the upper plate 8. The electromagnets are configured to produce rapid pulsing magnetic fields that serve alternately to attract and then release the upper plate 8 causing it to vibrate rapidly in an up and down direction. Further, the angles spring supports 7 impart a corresponding rotary vibration to the bowl 15 as it vibrates vertically. Such vibratory movement of the bowl 15, in turn, causes wrapped coin rolls within the reservoir 18 to migrate to the periphery thereof and move up the spiral ramp 19 to the exit port 30 in serial or single file fashion as shown in FIG. 1.

A slopped coin roll chute 17 is mounted to the frame 12 and has an upper end portion positioned adjacent the exit port 30 of bowl 15 o receive wrapped coin rolls therefrom. The coin roll chute 17 slopes generally downwardly and the left (FIG. 2) to terminate in a narrow lower end portion 31 (FIG. 3). The chute is generally V-shaped in cross section to cradle wrapped coin rolls received from the feeder bowl and an electrically activated vibrator 26 is adapted to vibrate the chute 17 to urged coin rolls therein to move down the chute from its upper end toward its lower end.

Figure 4:
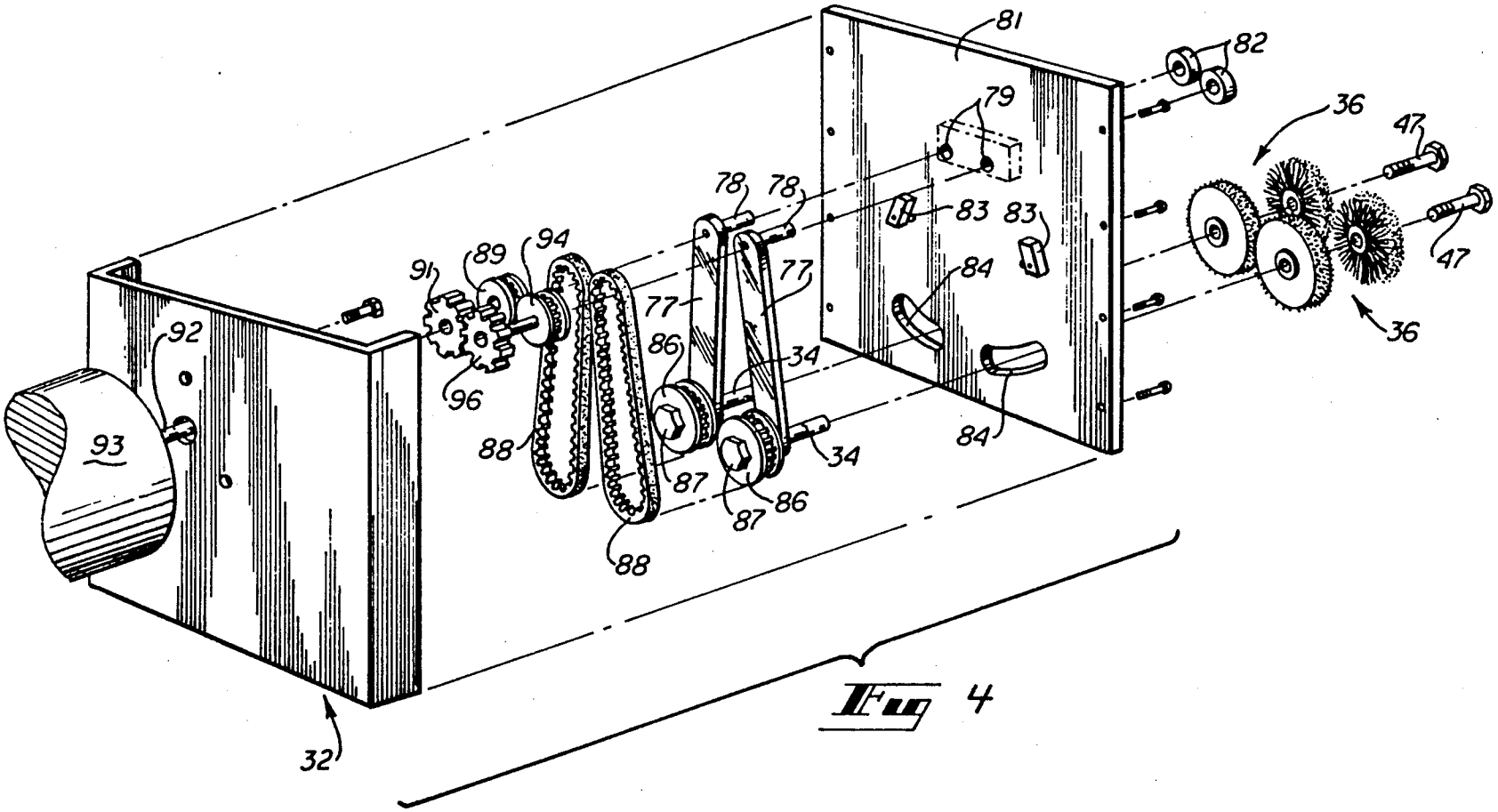
FIG. 4 is an exploded perspective view showing a preferred drive train for rotating the abrasive discs.

A pair of opposed contra-rotatable abrasive disc assemblies 376 are positioned to overlie and at least partially straddle the narrow lower end portion 31 of coin roll chute 17. A best illustrated in FIG. 4, each abrasive disc assembly 36 comprise a wire brush mounted adjacent to an in coaxial alignment with a hub having short wire bristles protruding from its periphery. Disc assemblies 36, then are secured with bolts 47 to the end of a corresponding shafts 34 that extend from a drive train housing 32 (FIG. 2). Within the housing ., each shaft 34 is rotatably disposed within the lower end of an elongated pivot arm 77. The upper end of each pivot arm 77 includes a pivot pin 78 sized to be received within a corresponding pivot bore 79 formed in the housing plate 81. A pair of locking rings 82 are adapted to be secured about the exposed ends of pivot pins 78 when they are in position within pivot bores 79 to secure the pins in their bores and limit longitudinal movement of pins 78 within bores 79.

The pivot arms 77 are thus pivotable about their respective pivot pins 78 to move the lower ends of the pivot arms and huts the shafts 34 and disc assemblies 36 toward and away from each other. A pair of arcuate slots 84 are formed in the housing plate 81 to accommodate relative movement of shafts 34 and a pair of spring loaded stop blocks 83 are secured to the housing plate 81 to restrict cushion outward pivotal movement of the arms 77 to a desired angular limit. In practice, the stop blocks 83 are adjusted to provide a maximum spacing between the abrasive disc assemblies appropriate for the size coin rolls being stripped of their wrappers.

Secured to the opposite end of each shaft 34, preferably with a bolt 87, is a driven sheave 86 configured to receive a corresponding drive belt 88. A first drive sheave 89 and corresponding drive gear 91 are secured to the shaft 92 of an electric motor 93 in juxtaposed coaxial relationship. A second drive sheave 94 and its corresponding drive gear 96 are mounted adjacent the first drive sheave and gear with the two gears positioned to align in meshed relationship. It is preferable for mounting and lubricating that the drive gears 91 and 96 be housed within a gear box secured to the interior of housing 32. Drive sheaves 89 and 94 are positioned to receive and drive the belts 88 and consequently to drive the sheaves 86, shafts 34 and abrasive disc assemblies 36 upon activation of electric motor 93. It will be understood from the forgoing discussion that as the first drive sheave 89 and its corresponding disc assembly 36 are rotated in one direction by the motor 93, the second drive sheave 94 and its corresponding abrasive disc assembly 36 are driven in the opposite direction by virtue of meshed gears 91 and 96. The abrasive disc assemblies 36 are thus caused to rotate in opposite directions and can therefore be described as contra-rotatable.

The just described drive train is housed within a housing 32 that is in turn secured to a vertically adjustable support 41. The housing 32 can thus be adjusted vertically to locate the abrasive disc assemblies 36 at a predetermined desired distance from and partially straddling the lower end of the chute 17 for bearing against and abrading wrappers from coin rolls. The housing 32 is also preferably pivotable to adjust the angle of the abrasive disc assemblies relative to the chute and thus to adjust the rate at which coin rolls are drawn into and abraded by the discs. The motor 93 is configured to cause rotation of the right disc assembly in FIG. 3 in a counterclockwise direction and the left disc assembly in a clockwise direction. Further, the disc assemblies 36 are angled toward the lower end portion of the chute 17 as best illustrated i FIG. 2, all for purposes detailed below.

Figure 5:
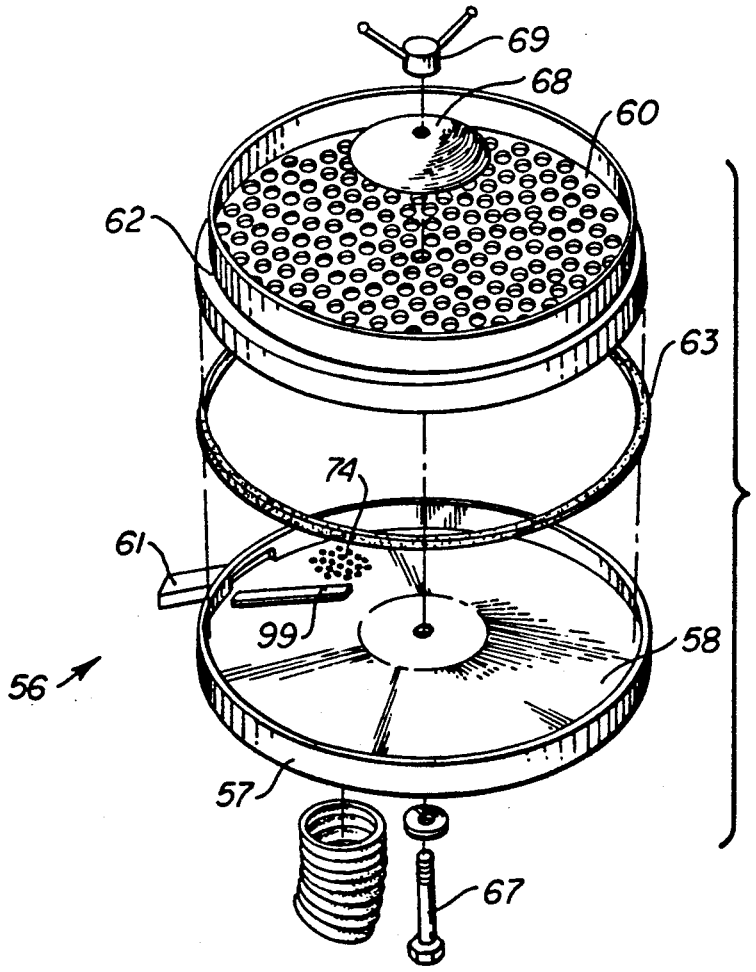
FIG. 5 is an exploded perspective view of the separating pan illustrating functional components thereof.

The end portion 31 of the chute 17 extends beyond the contra rotatable abrasive discs 36 to overlie a vibrating separator 56 for separating loose coins from their torn paper wrappers. As best seen in FIG. 5, the separator 56 includes a catch pan 57 having a floor 58 that slopes downwardly from the central portion of the pan to the periphery thereof. An exit port 61 is formed in the peripheral wall of the pan 57 and a raised stop 99 bus secured to the floor 58 of the pan adjacent the exit port 61 and extends in a generally radial direction relative to the pan floor. A skirt 62 is sized to fit snuggly within the peripheral wall of the pan 57. Mounted within the skirt 62 intermediate its top and bottom edges is a substantially flat formainous plate 60 that has a multitude of circular openings extending therethrough with the openings being sized to pass coins through the plate. With this configuration, the formainous plate 60 is supported in a substantially horizontal orientation spaced for the pan floor 58 when the skirt 62 is in position within the pan. The pan, skirt and plate can then be secured together by means of a bolt 67, washer 68 and winged nut 69 as illustrated in FIGS. 1 and 5.

A vacuum mechanism 72 includes a vacuum hose 73 that communicates with the interior of the pan 57 through vent openings 74 and a gasket 63 can be interposed between the skirt 62 and the pan peripheral walls if desired to seal off the space between the skirt and pan peripheral wall. As with the cascade feeder bowl, the separator 56 is mounted atop an electromagnetically activated vibrator 76 that imparts rapid rotary and vertical vibration to the collector 56. Such motion causes loose coins falling into the separator to pass though the holes of the formainous plate and into the pan while their torn wrappers remain atop the plate for manual or vacuum assisted collection and disposal. The vibratory motion further causes coins within the pan to migrate to the pan periphery where they move around the peripheral wall and are directed by the stop 99 through the exit port 61 for collection in a suitable container

OPERATION

In operation, the reservoir 18 of the cascade feeder bowl 15 is filled with wrapped coin rolls from, for example, a bag. The switches of switch panel 98 are then appropriately manipulated to activate the vibrator mechanisms upon which the feeder bowl 15 and separator 56 are supported and to activate the chute vibrator 26. The motor 93 is also activated to drive the abrasive disc assemblies in opposite directions as described above.

With the apparatus thus activated the vibratory motion of the feeder bowl 15 causes the wrapped coin rolls therein to migrate to the periphery of the bowl and thence up and around the spiral ramp in aligned single-file fashion to the exit port 30. From exit port 30, the wrapped coin rolls are received by the chute 17, the vibration of which causes the rolls to move down the chute toward the contra-rotating abrasive discs 36. The discs 36 pare positioned via adjustment bar 41 at a predetermined distance form the chute selected to cause the disc assemblies to bear against the wrapped coin rolls 16 as they move down the chute and past the discs to abrade any and tear the paper or plastic wrappers are from the coins therein. The direction of contra-rotation and the angles orientation of the discs relative to the chute serve to draw rolls past the discs, which then abrade away a strip of wrapper on either side of the rolls freeing coins.

As the freed coins and torn wrappers leave the chute, they fall into the separator 56 and onto the formainous plate 760. The openings in the plate 60 are sized to pass the loose coins, which fall through the plate and into the pan 57. The vibration of the pan 57, in combination with its sloped floor, then, causes the loose coins to migrate to and around the periphery of the pan toward the exit chute 61. Upon reaching the location the exit chute 61, the coins are directed by the stop 99 into the chute which further directs the coins into an appropriate awaiting container for collection. The torn wrapper remains atop the plate 60 can then be gathered together and discarded either manually or automatically as with an auxiliary vacuum system. Coins are thus removed and separated from their wrappers automatically, rapidly and with a minimum of human intervention.

The invention has been described in terms of a preferred embodiment. It will be obvious to persons of skill in the art, however, that various additions, defections and modifications could be made to the preferred embodiment within the scope of the invention. The abrasive discs, for example, have been described as bearing wire bristles for abrading wrappers. It is obvious, however, that other functionally equivalent means such as rubber hubs or discs that bear against and frictionally abrade away the wrappers could be substituted of the abrasive discs of the preferred embodiment. Therefore, the team "abrasive disc assemblies" as used herein should be understood to encompass any functionally equivalent means of abrading away coin roll wrappers. These and other modifications might well be made by persons of skill in the art without departing from the spirit and scope of the invention as set forth in the claims.

I claim:

1. An apparatus for removing wrappers from coin rolls with said apparatus comprising:

an elongated transfer means having first and second end portions;

means for moving coin rolls from said first end portion of said transfer means to said second end portion, thereof;

feeder means for feeding wrapped coin rolls sequentially to the first ned portion of said transfer means;

first and second contra-rotatable abrasive members positioned adjacent said transfer means with said abrasive members being spaced and positioned to bear against wrapped coin rolls moving along said transfer means to tear the wrappers therefrom;

receiving means for receiving coins and torn wrappers from the second end portion of said transfer means;

said receiving means including separator means for separating coins from their torn wrappers; and collector means for collecting the separated coins.

2. The apparatus of claim 1 wherein said elongated transfer means comprises a chute configured to cradle coin rolls therein, said chute being inclined downwardly from its first end portion to its second end portion.

3. The apparatus of claim 2 wherein said means for moving coin rolls from said first end portion of said transfer means to said second end portion thereof comprises means for vibrating said chute.

4. The apparatus of claim 1 wherein said feeder means comprises a cascade feeder bowl having a coin roll outlet positioned adjacent said first end portion of said transfer means for feeding coin rolls thereto.

5. The apparatus of claim 1 wherein said receiving means includes a pan with at least a portion of said pan positioned to underlie said second end portion of said transfer means.

6. The apparatus of claim 5 wherein said pan includes a floor and peripheral sides and wherein said separator means comprises a formainous plate within said pan spaced from said floor, said formainous plate defining openings sized to pass coins through said plate and to prevent passage of torn wrappers through said plate, whereby coins received by the pan pass through the formainous plate to the floor of the pan while torn wrappers are supported atop the formainous plate for collection and disposal.

7. The apparatus of claim 6 wherein said floor of said pan slopes downwardly from the central portion of said pan to the peripheral portion thereof and wherein said pan further includes a coin outlet at its periphery and wherein said apparatus further comprises means for vibrating said pan and said formainous plate whereby coins passing through the plate migrate to the periphery of the pan and out the coin outlet of recollection.

8. The apparatus of claim 7 wherein said collector means comprises a receptacle positioned to receive coins from said coin outlet.

9. The apparatus of claim 1 wherein said contra-rotatable abrasive members are positioned to overlie and at least partially straddle said second end portion of said transfer means.

10. The apparatus of claim 9 wherein said abrasive members are mounted for rotation about spaced parallel axes.

11. The apparatus of claim 10 wherein said contra-rotatable abrasive members are angled relative to the path of movement of coin rolls along said transfer means to urge coin rolls toward the second end portion of said transfer means.

* * * * *